US010405381B2

(12) United States Patent
Lee et al.

(10) Patent No.: US 10,405,381 B2
(45) Date of Patent: Sep. 3, 2019

(54) LIGHT EMITTING DIODE CONTROL CIRCUIT WITH WIDE RANGE INPUT VOLTAGE

(71) Applicant: FAIRCHILD KOREA SEMICONDUCTOR LTD., Bucheon (KR)

(72) Inventors: Minwoo Lee, Bucheon (KR); Moonsik Song, Bucheon (KR); Seunguk Yang, Anyang (KR)

(73) Assignee: SEMICONDUCTOR COMPONENTS INDUSTRIES, LLC, Phoenix, AZ (US)

( * ) Notice: Subject to any disclaimer, the term of this patent is extended or adjusted under 35 U.S.C. 154(b) by 53 days.

(21) Appl. No.: 15/601,034

(22) Filed: May 22, 2017

(65) Prior Publication Data

US 2017/0354003 A1 Dec. 7, 2017

Related U.S. Application Data

(60) Provisional application No. 62/344,752, filed on Jun. 2, 2016.

(51) Int. Cl.
*H05B 33/08* (2006.01)
*H05B 37/02* (2006.01)

(52) U.S. Cl.
CPC ..... *H05B 33/0815* (2013.01); *H05B 33/083* (2013.01); *H05B 33/0842* (2013.01); *H05B 33/0851* (2013.01); *H05B 37/02* (2013.01)

(58) Field of Classification Search
CPC combination set(s) only.
See application file for complete search history.

(56) References Cited

U.S. PATENT DOCUMENTS 4,654,575 A * 3/1987 Castleman ..... H02J 7/0034 320/DIG. 20
8,115,422 B2 * 2/2012 Sasaki ..... H05B 33/0812 315/210
2008/0309355 A1 * 12/2008 Nozaki ..... G01R 1/06766 324/754.01
2010/0079124 A1 * 4/2010 Melanson ..... H02M 3/156 323/283
2011/0285312 A1 * 11/2011 Choutov ..... H05B 33/0815 315/291
2012/0212145 A1 * 8/2012 Chan ..... H05B 33/0815 315/200 R

* cited by examiner

*Primary Examiner* — Douglas W Owens
*Assistant Examiner* — Jianzi Chen
(74) *Attorney, Agent, or Firm* — Dickinson Wright PLLC

(57) ABSTRACT

A light emitting diode (LED) control circuit includes an inductor current sense circuit with a high-side diode string, a low-side diode string, and a sense resistor in series with and between the high-side and low side diode strings. The LED control circuit receives an input voltage on an end that connects to the high-side diode string. An end of the low-side diode string is connected to a switch through an inductor. A sense voltage developed on the sense resistor by an inductor current is sensed by a controller integrated circuit (IC). A pin of the controller IC that receives the sense voltage can have a breakdown voltage specification that is lower than the input voltage.

18 Claims, 5 Drawing Sheets

LIGHT EMITTING DIODE CONTROL CIRCUIT WITH WIDE RANGE INPUT VOLTAGE

CROSS-REFERENCE TO RELATED APPLICATION

This application claims the benefit of U.S. Provisional Application No. 62/344,752, filed on Jun. 2, 2016, which is incorporated herein by reference in its entirety.

BACKGROUND OF THE INVENTION

1. Field of the Invention

The present invention relates generally to electrical circuits, and more particularly but not exclusively to light emitting diode control circuits.

2. Description of the Background Art

A light emitting diode (LED) may be used in various lighting applications. For example, one or more LEDs may provide illumination by driving the LEDs using a transistor. An LED control circuit may receive an input voltage and control a switching operation of the transistor to control illumination of the LEDs. The input voltage that can be received by the LED control circuit is limited by the electrical characteristics of its components. Providing an input voltage that is higher than a maximum specified input voltage may damage the LED control circuit and cause a safety issue. Accordingly, the LED control circuit has a limited range of input voltages.

SUMMARY

In one embodiment, an LED control circuit includes an inductor current sense circuit with a high-side diode string, a low-side diode string, and a sense resistor in series with and between the high-side and low side diode strings. The LED control circuit receives an input voltage on an end that connects to the high-side diode string. An end of the low-side diode string is connected to a switch through an inductor. A sense voltage developed on the sense resistor by an inductor current is sensed by a controller integrated circuit. A pin of the controller integrated circuit that receives the sense voltage can have a breakdown voltage specification that is lower than the input voltage.

These and other features of the present invention will be readily apparent to persons of ordinary skill in the art upon reading the entirety of this disclosure, which includes the accompanying drawings and claims.

Figure 1:
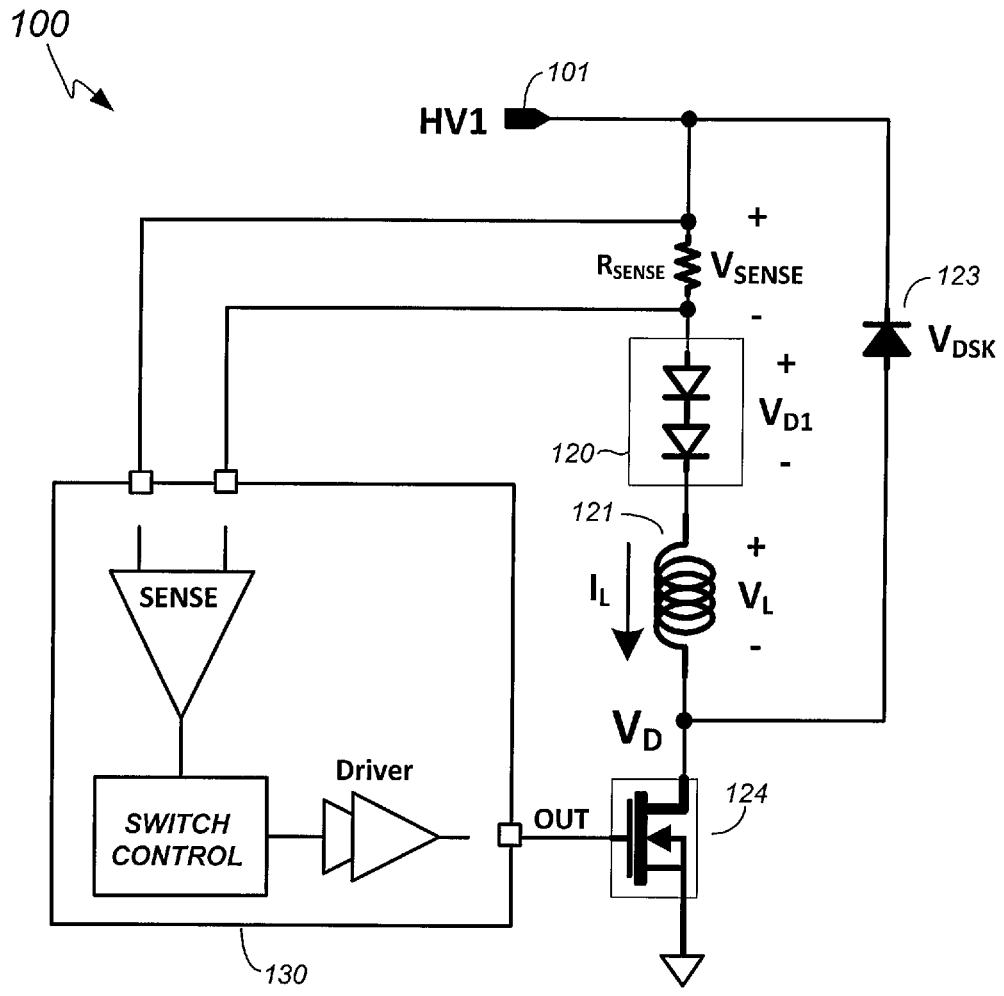
FIG. 1 shows an example LED control circuit.

The use of the same reference label in different drawings indicates the same or like components.

DETAILED DESCRIPTION

In the present disclosure, numerous specific details are provided, such as examples of circuits, components, and methods, to provide a thorough understanding of embodiments of the invention. Persons of ordinary skill in the art will recognize, however, that the invention can be practiced without one or more of the specific details. In other instances, well-known details are not shown or described to avoid obscuring aspects of the invention.

For ease of reading, subscripts and superscripts that appear in the drawings are formatted herein with normal fonts. For example, a signal that is labeled in the drawings as $V_{EXAMPLE}$ is simply written below as VEXAMPLE.

FIG. 1 shows an example LED control circuit 100 for controlling illumination of an LED circuit 123. The LED circuit 123 may be a single LED or a plurality of series-connected LEDs. The LED control circuit 100 receives an input voltage HV1 at a node 101. The input voltage HV1 may be a high DC (direct current) voltage. The input voltage HV1 is connected to a diode string 120 and an inductor 121 by way of a sense resistor RSENSE. The diode string 120 may be a single diode or a plurality of diodes that are connected in series. A control integrated circuit (IC) 130 controls a switching operation of a transistor 124 based on the inductor current IL, which is sensed by the controller IC 130 by way of a sense voltage VSENSE that is developed across the sense resistor RSENSE.

Figure 2:
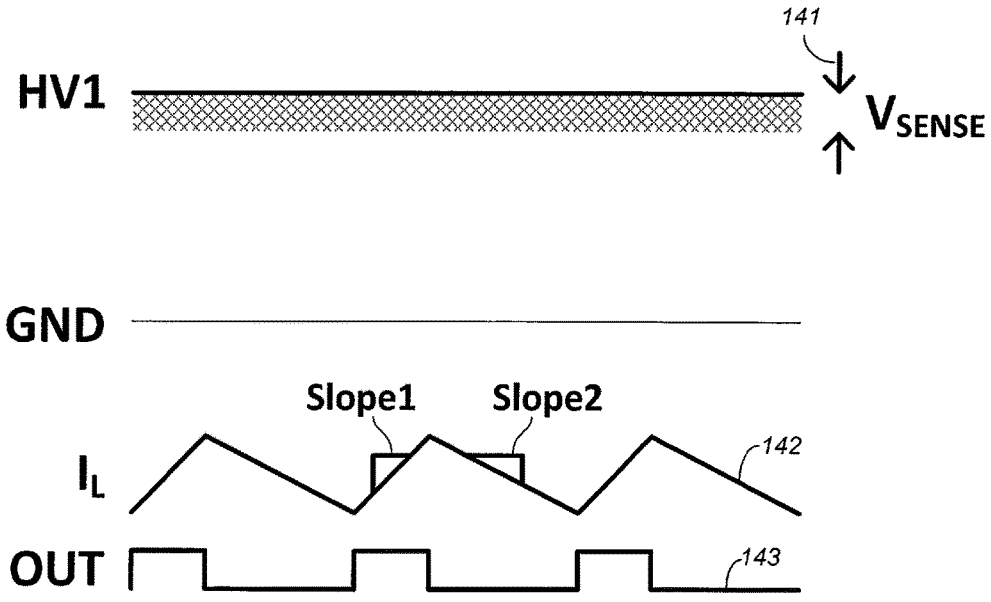
FIG. 2 shows waveforms of signals of the LED control circuit of FIG. 1.

FIG. 2 shows waveforms of signals of the LED control circuit 100 of FIG. 1. FIG. 2 shows the input voltage HV1 relative to ground (GND), the inductor current IL through the inductor 121 (FIG. 2, 142), and the gate signal OUT to the gate of the transistor 124 (FIG. 2, 143). For proper operation, the sense voltage VSENSE is expected to be within a limited range of values below the input voltage HV1 (FIG. 2, 141).

The inductor current IL increases when the transistor 124 is turned on, and decreases when the transistor 124 is turned off. The slope of the inductor current IL when it is increasing (FIG. 2, Slope1) is given by $$V_L = (HV1 - V_{SENSE} - V_{D1}) - V_{DS} \approx HV1 - V_{D1}$$

$$\Delta I_L = \frac{HV1 - V_{D1}}{L}$$

where VL is the voltage across the inductor 121, HV1 is the input voltage at the node 101, VSENSE is the voltage across the sense resistor RSENSE, VD1 is the forward voltage drop across the diode string 120, VDS is the drain-to-source voltage of the transistor 124, and L is the inductance of the inductor 121. The slope of the inductor current IL when it is decreasing (FIG. 2, Slope2) is given by $$V_L = (HV1 - V_{SENSE} - V_{D1}) - (HV1 + V_{DSK}) \approx -V_{D1}$$

$$\Delta I_L = -\frac{V_{D1}}{L}$$

where VL is the voltage across the inductor 121, HV1 is the input voltage at the node 101, VD1 is the forward voltage drop across the diode string 120, VSENSE is the voltage across the sense resistor RSENSE, VDSK is the forward voltage drop across the LED circuit 123, and L is the inductance of the inductor 121. From the above equations, it can be seen that the sense voltage VSENSE does not appreciably affect the slope of the inductor current IL, and thus the operation of the LED control circuit 100. The slope of the inductor current may be determined from the input voltage, the forward voltage drop of the diode string 120, and the input voltage.

The sensing pins of the controller IC 130 for receiving the sense voltage VSENSE and for receiving a supply voltage for an internal regulator that generates the VCC of the controller IC 130 have a breakdown voltage specification, which is dictated by the breakdown voltage of the input transistor of the sensing pin. For a metal oxide semiconductor field effect transistor (MOSFET), the breakdown voltage is referred to as "BVDSS", which is the voltage at which the reverse-biased body-drift diode breaks down and significant current starts to flow between the source and drain by the avalanche multiplication process, while the gate and source are shorted together. The breakdown voltage specification of the sensing pins of the controller IC 130 must be higher than the input voltage HV1 to avoid damaging the controller IC 130. This limits the range of input voltages that can be received by the LED control circuit 100.

Figure 3:
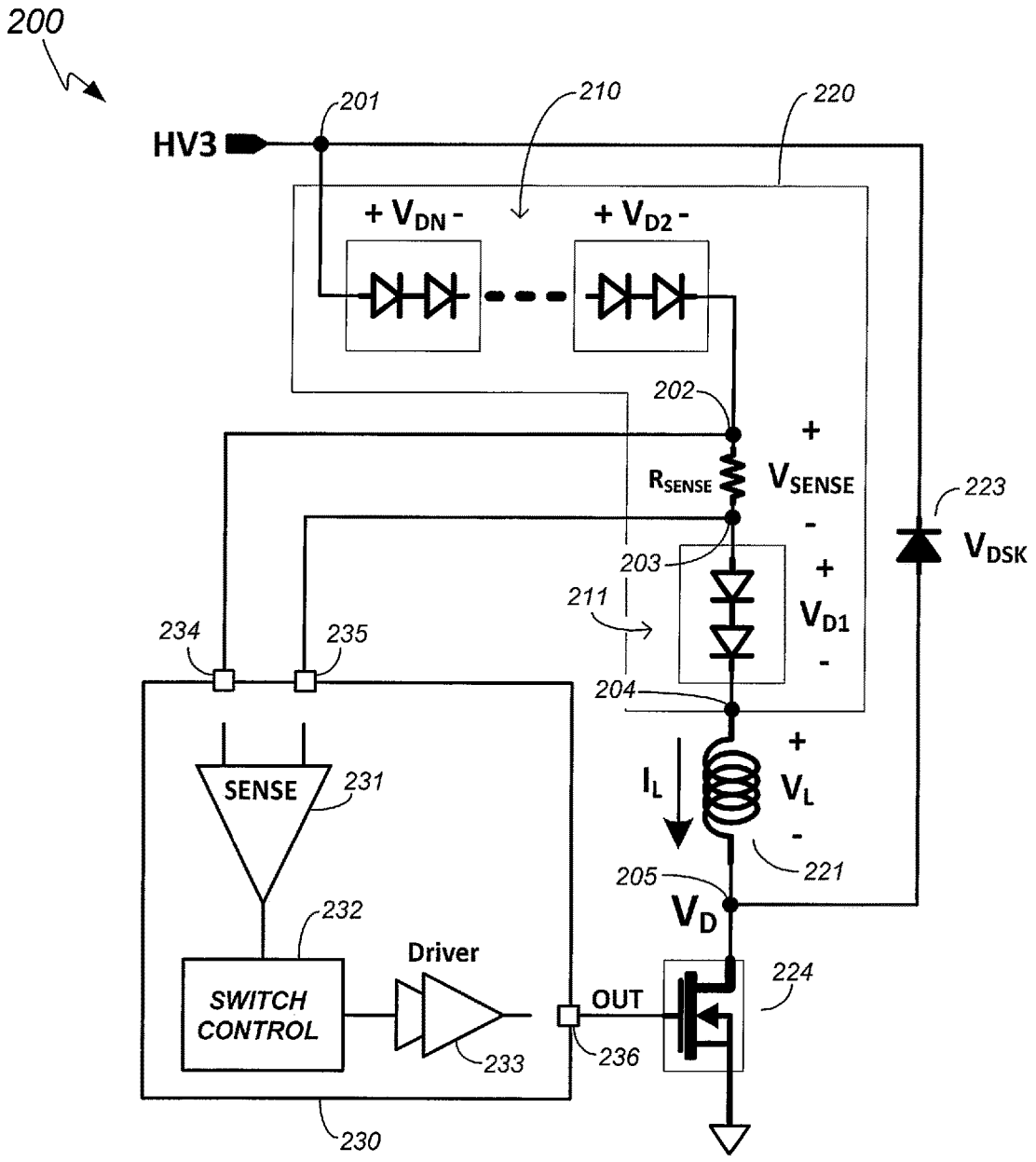
FIG. 3 shows a schematic diagram of an LED control circuit in accordance with an embodiment of the present invention.

FIG. 3 shows a schematic diagram of an LED control circuit 200 for controlling illumination of an LED circuit 223 in accordance with an embodiment of the present invention. The LED circuit 223 may comprise one or more LEDs. The LED control circuit 200 receives an input voltage HV3 at a node 201. The input voltage HV3 may be a high DC voltage. In the example of FIG. 3, an inductor current sense circuit 220 is connected to the input voltage HV3 at the node 201 and is connected to an end of an inductor 221 at a node 204. The inductor current sense circuit 220 advantageously allows a controller IC 230 to sense input voltages that are higher than a breakdown voltage of pins of the controller IC 230.

In the example of FIG. 3, the inductor current sense circuit 220 comprises a high-side diode string 210, a sense resistor RSENSE, and a low-side diode string 211. The sense resistor RSENSE may comprise a single resistor or a plurality of resistors that are connected in series. The high-side diode string 210 may comprise a single diode or a plurality of diodes that are connected in series. The high-side diode string 210 is so named because it is connected to the input voltage HV3 at the node 201 on one end, and to a high-side end (i.e., high voltage side) of the resistor RSENSE at the node 202. The low-side diode string 211 may comprise a single diode or a plurality of diodes that are connected in series. The low-side diode string 211 is so named because it is connected to the low-side end (i.e., low voltage side) of the resistor RSENSE at the node 203 on one end, and to an end of the inductor 221 at the node 204 on the other end.

In the example of FIG. 3, the voltage VSENSE developed across the sense resistor RSENSE is received by the controller IC 230 on a pin 235. The controller IC 230 further includes a pin 234 for receiving a supply voltage for an internal regulator that generates a VCC voltage that powers up the controller IC 230. Because the input impedance of each of the pins 234 and 235 is relatively high, the high-side diode string 210, the sense resistor RSENSE, and the low-side diode string 211 are connected in series.

In the example of FIG. 3, the LED control circuit 200 has a buck topology that includes a switch in the form of a transistor 224 (e.g., MOSFET). In one embodiment, the transistor 224 is external to the controller IC 230 as depicted in FIG. 3. In other embodiments, the transistor 224 is incorporated in the controller IC 230 (i.e., within the IC package). A drain of the transistor 224 is connected to the end of the inductor 221 at the node 205, and a source of the transistor 224 is connected to ground. More particularly, the drain of the transistor 224 receives the input voltage HV3 by way of the inductor 221 and the inductor current sense circuit 220. In the example of FIG. 3, a cathode of the LED circuit 223 is connected to the input voltage HV3 at the node 201, and an anode of the LED circuit 223 is connected to the drain of the transistor 224 at the node 205.

The transistor 224 is configured to connect and disconnect the input voltage HV3 to ground. When the transistor 224 is on, the input voltage HV3 is connected to ground, and is thus connected to the LED control circuit 200 to develop an inductor current IL through the inductor 221. The inductor 221 develops a voltage VL, which counteracts the input voltage HV3, thereby developing a voltage VDSK across the LED circuit 223 that is less than the input voltage HV3. The input voltage HV3 is disconnected from the LED control circuit 200 when the transistor 224 is turned off, thereby causing the inductor current IL to decrease and flow through the LED circuit 223.

In the example of FIG. 3, the controller IC 230 includes the pin 234 for receiving the supply voltage for generating the VCC voltage of the controller IC 230, the pin 235 for receiving the sense voltage VSENSE, and a pin 236 that is connected to a gate of the transistor 224. The controller IC 230 may include a sense circuit 231 for receiving and sensing the sense voltage VSENSE. The inductor current IL flows to the sense resistor RSENSE to develop the sense voltage VSENSE. Accordingly, the sense voltage VSENSE is indicative of the inductor current IL. The controller IC 230 includes a switch control circuit 232 that controls the switching operation of the transistor 224 based on the inductor current IL, as sensed by the sense circuit 231 by way of the sense voltage VSENSE.

In one embodiment, the switch control circuit 232 controls the switching operation of the transistor 221 by hysteretic control. The switch control circuit 232 asserts the gate signal OUT when the sense voltage VSENSE reaches a low reference threshold, and de-asserts the gate signal OUT when the sense voltage VSENSE reaches a high reference threshold. The gate signal OUT generated by the switch control circuit 232 drives the gate of the transistor 224 by way of a driver circuit 233.

Figure 4:
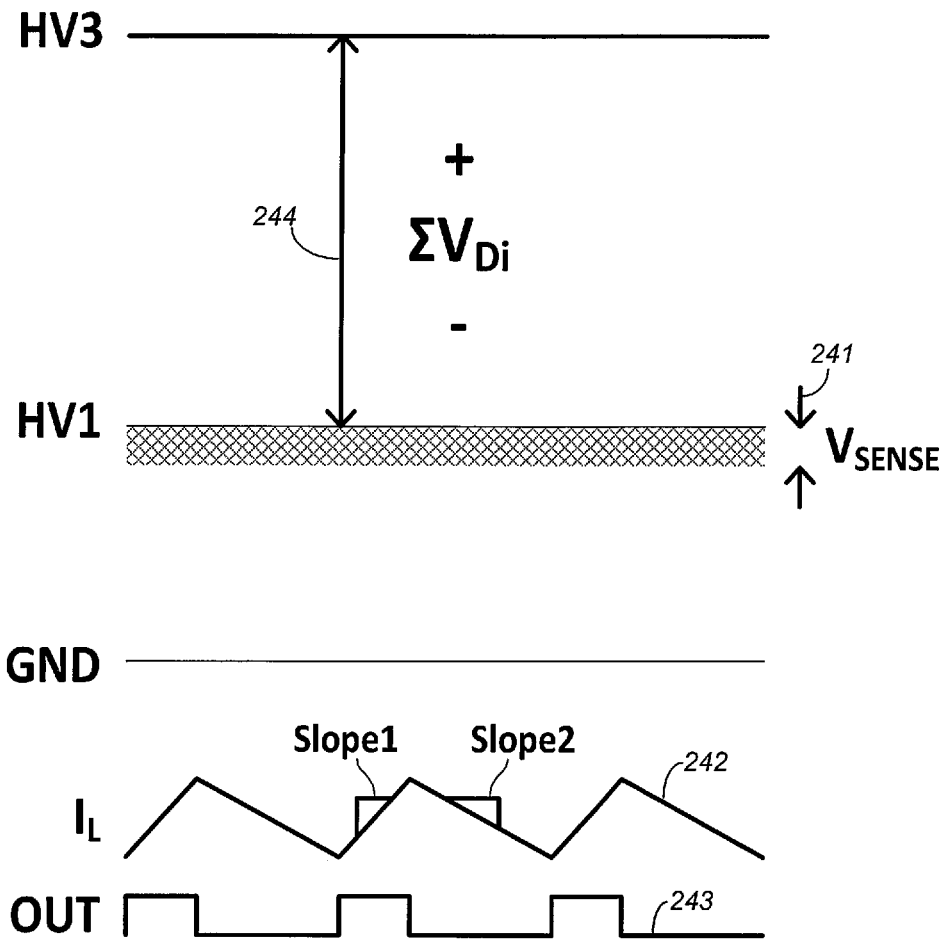
FIG. 4 shows waveforms of signals of the LED control circuit of FIG. 3.

FIG. 4 shows waveforms of signals of the LED control circuit 200 of FIG. 3. FIG. 4 shows the input voltage HV3 relative to ground (GND), the inductor current IL through the inductor 221 (FIG. 4, 242), and the gate signal OUT to gate of the transistor 224 (FIG. 4, 243). As shown in FIG. 4, the input voltage HV3 is higher than the input voltage HV1 of the LED control circuit 100 of FIG. 1. In the example of FIG. 4, the input voltage HV3 is higher than the input voltage HV1 by the sum of the forward voltage drops of the high-side diode string 210 (FIG. 4, 244), which allows, the sense voltage VSENSE to remain just below the level of the voltage HV1 (FIG. 4, 241) as in FIG. 1. More particularly, even with a high input voltage HV3 at the node 201, the sense voltage VSENSE is relatively low and may be as low as the input voltage HV3 minus the forward voltage drops of the high-side diode string 210. Accordingly, the breakdown voltage specification of the sensing pins of the controller IC 230 may be the same as the breakdown voltage of the sensing pins of the controller IC 130 of FIG. 1, and yet the LED control circuit 200 is able to accept an input voltage HV3 that is much higher than the voltage HV1. More particularly, the breakdown voltage specification of the sensing pins of the controller IC 230 (e.g., pins 234 and 235) may be higher than the voltage HV1 but lower than the input voltage HV3. In marked contrast, in the LED control circuit 100 of FIG. 1, the breakdown voltage specification of the sensing pins of the controller IC 130 must be higher than the input voltage.

Still referring to FIG. 4, the inductor current IL increases when the transistor 224 is turned on, and decreases when the transistor 224 is turned off. The equations for the slope of the inductor current IL when it is increasing (FIG. 4, Slope1) and when it is decreasing (FIG. 4, Slope2) are given by the same equations explained above for the LED control circuit 100 of FIG. 1.

Figure 5:
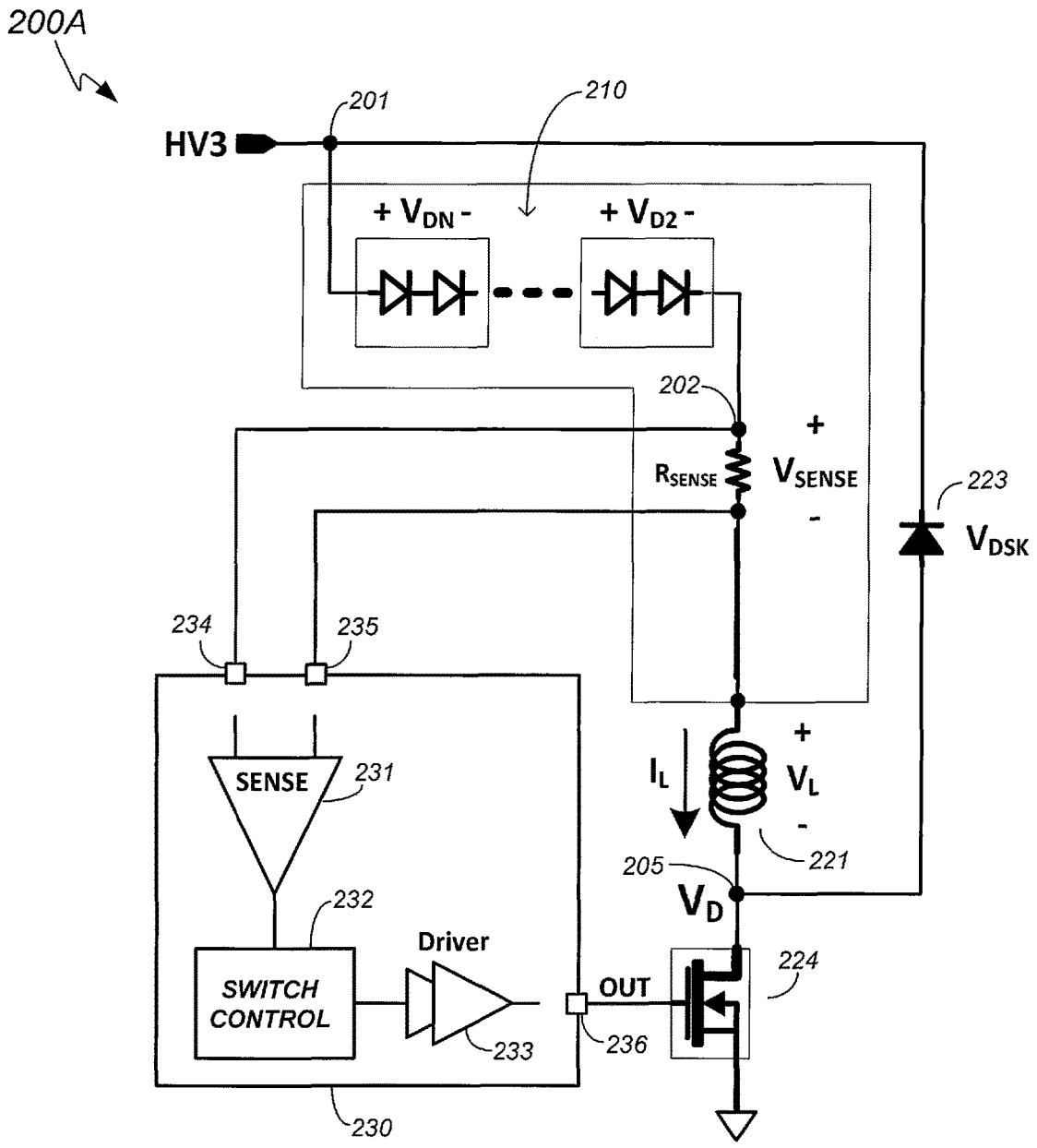
FIG. 5 shows a schematic diagram of an LED control circuit in accordance with an embodiment of the present invention.

The low-side diode string 211 may be omitted in some applications. For example, FIG. 5 shows a schematic diagram of an LED control circuit 200A in accordance with an embodiment of the present invention. The LED control circuit 200A is a particular implementation of the LED control circuit 200 of FIG. 3. The LED control circuit 200A is the same as the LED control circuit 200 except that the inductor current sense circuit does not include a low-side diode string 211. The operations and components of the LED control circuits 200 and 200A are otherwise the same.

In the example of FIG. 5, the voltage received on the pin 234 for generating the VCC of the controller IC 230 will be larger than the VCC in most applications. However, in applications where the resulting voltage on the pin 234 is very close to the VCC, the internal regulator that generates the VCC may not remain operational. In those applications, an inductor current sense circuit with the sense resistor RSENSE between the first and second diode strings as in FIG. 3 should be employed.

As can be appreciated from the foregoing, features of the present invention allow LED control circuits to accept a wide range of input voltages. Features of the present invention may be incorporated in the LED control circuit 100 of FIG. 1, and other LED control circuits, as a retrofit. Furthermore, features of the present invention allow LED control circuits with low or medium voltage controller ICs to accept higher input voltages.

LED control circuits and methods of operating same have been disclosed. While specific embodiments of the present invention have been provided, it is to be understood that these embodiments are for illustration purposes and not limiting. Many additional embodiments will be apparent to persons of ordinary skill in the art reading this disclosure.

What is claimed is:

1. A light emitting diode (LED) control circuit comprising:

a high-side diode string having a first end and a second end, the first end of the high-side diode string connected to an input voltage of the LED control circuit;

a sense resistor having a first end and a second end, the first end of the sense resistor connected to the second end of the high-side diode string;

an inductor having a first end and a second end, the first end of the inductor coupled to the second end of the sense resistor;

a switch that is configured to connect and disconnect the second end of the inductor to ground;

an LED circuit having a first end and a second end, the first end of the LED circuit coupled directly to a switch node between the inductor and the switch, the second end of the LED circuit coupled to the input voltage, and the LED circuit distinct from the high-side diode string; and a controller integrated circuit (IC) that is configured to receive a sense voltage that is developed on the sense resistor and to control a switching operation of the switch;

wherein the controller IC has a first pin that is configured to receive the sense voltage, and wherein a breakdown voltage specification of the first pin is lower than the input voltage.

2. The LED control circuit of claim 1, further comprising:

a low-side diode string coupled between the sense resistor and the inductor, the low-side diode string distinct from the high-side diode string and the LED circuit, and wherein the high-side diode string, the sense resistor, and the low-side diode string are connected in series.

3. The LED control circuit of claim 2, wherein the low-side diode string comprises a plurality of diodes that are connected in series.

4. The LED control circuit of claim 1, wherein the controller IC comprises a second pin that outputs a control signal to the switch.

5. The LED control circuit of claim 1, wherein the high-side diode string comprises a plurality of diodes that are connected in series.

6. The LED control circuit of claim 1, wherein the switch is a MOSFET.

7. The LED control circuit of claim 1, wherein the switch is external to the controller IC.

8. The LED control circuit of claim 1, wherein the second end of the LED circuit is coupled to the input voltage.

9. The LED control circuit of claim 1 further comprising:

the first end of the high-side diode string coupled directly to the input voltage;

the second end of the high-side diode string coupled directly to the first end of the sense resistor;

the second end of the inductor coupled directly to the switch node;

the switch defines a first connection, a second connection, and a gate connection, the first connection coupled directly to the switch node, the second connection coupled directly to ground, and the gate connection coupled to the controller IC;

the second end of the LED circuit coupled directly to the input voltage.

10. The LED control circuit of claim 9 further comprising a low-side diode string having a first end and a second end, the first end of the low-side diode string coupled directly to the second end of the sense resistor, and the second end of the low-side diode string coupled directly to the inductor.

11. The LED control circuit of claim 1, wherein all the light produced by the LED control circuit is produced by the LED circuit.

12. A light emitting diode (LED) control circuit comprising:

an inductor current sense circuit having a first node and a second node, the inductor current sense circuit comprising:

a first diode string having a first end and a second end, the first end of the first diode string defining the first node; and a sense resistor having a first end and a second end, the first end of the sense resistor coupled to the second end of the diode string such that the sense resistor is connected in series with the first diode string between the first node and the second node;

wherein the inductor current sense circuit is configured to receive an input voltage to the LED control circuit at the first node;

a switch having a first terminal that receives the input voltage through the inductor current sense circuit and a second terminal that is connected to ground;

an inductor coupled between the switch and the second node of the inductor current sense circuit; and an LED circuit connected between the first node and the first terminal of the switch in parallel with the first diode string; and a controller integrated circuit (IC) that is configured to control a switching operation of the switch to connect and disconnect the input voltage to ground, the controller integrated circuit IC having a first pin that receives a sense voltage on the sense resistor, the first pin having a breakdown voltage specification that is lower than the input voltage.

13. The LED control circuit of claim 12, wherein the inductor current sense circuit further comprises a second diode string that is in series with the first diode string and the sense resistor, and wherein the sense resistor is between the first diode string and the second diode string.

14. The LED control circuit of claim 12, wherein the switch comprises a metal oxide semiconductor field effect transistor (MOSFET).

15. The LED control circuit of claim 14, wherein the controller IC has a second pin that outputs a gate control signal to a gate of the MOSFET.

16. The LED control circuit of claim 12, wherein the LED circuit comprises a plurality of LEDs that are connected in series.

17. A method of operating a light emitting diode (LED) control circuit, the method comprising:

receiving an input voltage at a first end of a first diode string;

turning on a switch to flow an inductor current through the first diode string, and then through a sense resistor, and then through an inductor, and then through the switch to ground, the inductor current developing a sense voltage on the sense resistor;

receiving the sense voltage on a controller integrated circuit (IC), receiving the sense voltage on a pin of the controller IC that has a breakdown voltage specification that is lower than the input voltage;

controlling, by the controller IC, a switching operation of the switch in accordance with the sense voltage.

18. The method of claim 17, further comprising:

developing a voltage on an LED circuit that is connected in parallel with the sense resistor.

* * * * *